US007396323B2

(12) United States Patent
Giro Amigo

(10) Patent No.: US 7,396,323 B2
(45) Date of Patent: Jul. 8, 2008

(54) FOLDING BLADE

(75) Inventor: Ezequiel Giro Amigo, Badalona (ES)

(73) Assignee: Giro GH, S.A., Badalona (ES)

( * ) Notice: Subject to any disclaimer, the term of this patent is extended or adjusted under 35 U.S.C. 154(b) by 0 days.

(21) Appl. No.: 11/561,911

(22) Filed: Nov. 21, 2006

(65) Prior Publication Data

US 2007/0123407 A1 May 31, 2007

(30) Foreign Application Priority Data

Nov. 30, 2005 (ES) ..... 200502628 U

(51) Int. Cl.
*B21B 1/28* (2006.01)

(52) U.S. Cl. ..... 493/471; 493/263; 493/457

(58) Field of Classification Search ..... 493/243, 493/254, 257–259, 263, 282, 308, 457–459
See application file for complete search history.

(56) References Cited

U.S. PATENT DOCUMENTS 2,925,699 A * 2/1960 Ozor ..... 53/370.6
3,167,897 A * 2/1965 Hopkins et al. ..... 53/138.5
4,070,853 A * 1/1978 Sanders ..... 53/370.6
4,079,662 A * 3/1978 Puccetti et al. ..... 53/552
4,579,154 A * 4/1986 Muller ..... 141/59
4,589,247 A * 5/1986 Tsuruta et al. ..... 53/550
5,048,270 A * 9/1991 McMahon ..... 53/551

* cited by examiner

*Primary Examiner*—Thanh K Truong
(74) *Attorney, Agent, or Firm*—Sughrue Mion, PLLC

(57) ABSTRACT

Folding blade (1) that is particularly applicable to devices for the closure of flexible tubular packaging, taking the form of a flat plate, provided on one of its lateral edges with a tab (5) in the form of a hook that is adapted to hold the packaging, of the type that is disposed opposite and perpendicular to a lateral portion of the packaging and attached to an axis of rotation (3) that transmits thereto a reciprocating rotational movement around the axis. This folding blade (1) comprises a main body (2) that can be attached to the axis of rotation; an end portion (4) provided with a tab (5) that is joined by articulation to the main body by its free end opposite the axis of rotation (3); and an elastic means (6) that exerts a permanent pulling force on said end portion, thus maintaining it in the initial position, folded over the main body of the blade.

5 Claims, 2 Drawing Sheets

FOLDING BLADE

TECHNICAL FIELD OF THE INVENTION

The invention relates to a folding blade that is particularly applicable to devices for the closure of flexible tubular packaging, such as mesh bags.

The folding blade takes the form of a flat plate, provided on its lateral edges with a tab in the form of a hook that is adapted to hold the packaging during the folding operation that is performed simultaneously to the closure of its upper aperture. In these devices for the closure of packaging, the folding blades are disposed perpendicularly opposite a lateral portion of the packaging, attached to a respective axis of rotation that transmits thereto a reciprocating rotational movement around the axis in each cycle of the closure operation, first in the direction towards the packaging to be closed, holding and pushing a portion of its lateral wall to create an inward fold, and subsequently in the opposite direction.

BACKGROUND OF THE INVENTION

There is a large variety of known automatic filling machines for flexible tubular packaging, such as mesh bags for packaging fruit and vegetable products, which generally comprise a pair of clips that hold the packaging to be filled through its upper aperture, in an open position, while the packaging is filled. Once the packaging has been filled, it is then closed, which is normally achieved by pushing together the clips holding the packaging, closing its upper part, then joining the two opposite closure portions of the edge of the packaging's upper aperture.

In order to ensure an optimum closure of the packaging, it is common to fold the lateral portions of the packaging between the closure portions that have been joined, so that the resulting folds are positioned, at least partially, between said joined portions, these lateral portions being folded similarly to an accordion.

A particular type of folding device that is applicable to the closure of this type of packaging comprises two folding blades disposed opposite each other in a direction perpendicular to a respective lateral portion of the packaging, attached to a respective axis of rotation that transmits thereto a reciprocating rotational movement around the axis. In each operational cycle, the folding blades rotate first in the direction towards the packaging to be closed, its ends pushing the respective lateral portion of the packaging and creating an inward fold, and subsequently rotating in the opposite direction, recovering their initial position in order to receive the next portion of packaging to be filled and closed.

The folding blades take the form of a flat plate and they are provided on their lateral edges with a tab in the form of a hook. This tab is adapted to hold and push the packaging during the folding operation by retaining at least one of the openings in the mesh of the opposite portion of packaging.

The use of the aforementioned folding blades tends to put a strain on the threads or tapes of the mesh of the packaging when the blades rotate and push the respective lateral portions inwards and the tabs pull on one of the openings in the mesh. This strain can cause the mesh of the packaging to be damaged or even broken during the subsequent handling of the filled packaging.

Furthermore, in the use of devices for the closure of packaging by sticking together said opposite portions that include the formation of lateral folds, it is normal for small sections of the strands that form the threads or tapes of the packaging to protrude from the opposite lateral portions that are stuck together, causing a flawed outer appearance or a poor presentation of the packaging filled with the product.

EXPLANATION OF THE INVENTION

To provide a solution to the problems posed above, the invention proposes a folding blade that is particularly applicable to devices for the closure of flexible tubular packaging.

The folding blade takes the form of a flat plate, provided on one of its lateral edges with a tab in the form of a hook that is adapted to hold the packaging, and it is a folding blade of the type that is disposed opposite and perpendicular to a lateral portion of the packaging and attached to an axis of rotation that transmits thereto a reciprocating rotational movement around the axis, first in the direction towards the packaging to be closed, pushing an opposite portion of its lateral wall and producing an inward fold, and subsequently in the opposite direction, in each of the device's operational cycles.

The folding blade is essentially characterised in that it comprises a main body that can be attached to the axis of rotation; an end portion provided with a tab, joined by articulation to the main body by its free end opposite the axis of rotation and adapted to rotate around an axis of rotation that is coplanar with the main body, from an initial position; and an elastic means that exerts a permanent pull on said end portion, thus maintaining it in the initial position, folded over the main body of the blade, so that if a predetermined force is exerted on the tab by the packaging, the end portion rotates and the tab defines a curvilinear path in relation to the axis of rotation of the end portion and, when said force stops, it returns to its initial position due to the pulling tendency of the elastic means.

According to another characteristic of the invention, the end portion comprises a means of blowing that is adapted to supply air in the direction of the opposite lateral wall of the packaging where the fold is formed.

BRIEF DESCRIPTION OF THE DRAWINGS

In the attached drawings a preferred embodiment of the folding blade that is the object of the invention is illustrated by means of a non-limiting example. In said drawings.

DETAILED DESCRIPTION OF THE DRAWINGS

Figure 1:
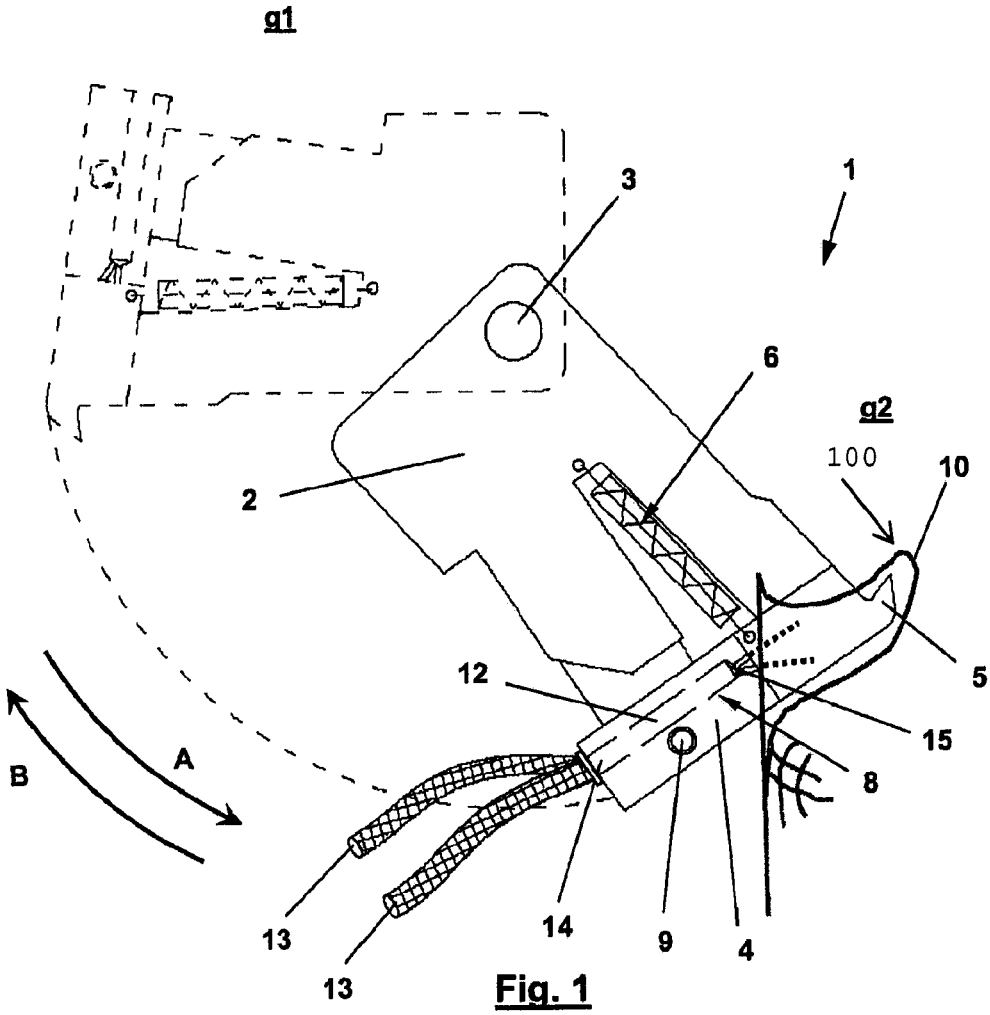
FIG. 1, is a schematic lateral elevation view of the blade that is the object of the invention, shown in its reciprocating rotational movement around its axis of rotation, the end portion of which is in the initial position.
Figure 2:
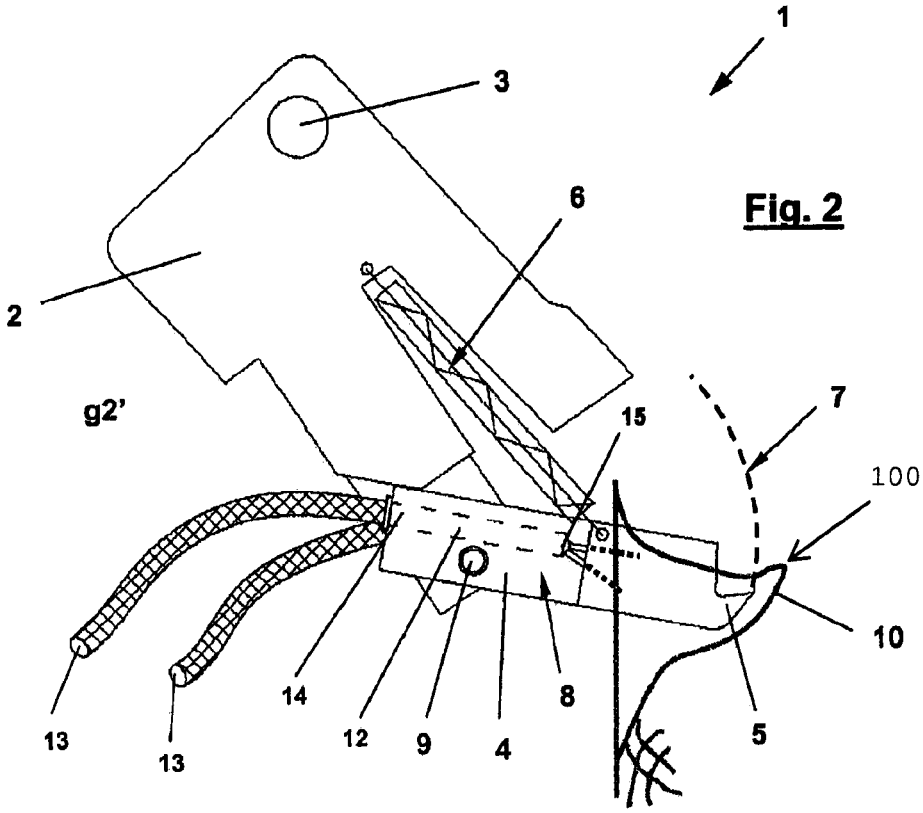
FIG. 2, is another schematic view of the folding blade of FIG. 1, in which the end portion thereof is in the position of maximum rotation in relation to the main body of the blade.

FIGS. 1 and 2 show a folding blade 1 of the type that forms part of a folding device that is applicable to the closure of flexible tubular packaging, such as mesh bags, by sticking two opposite portions of the same edge of the packaging to be closed once it has been filled.

The folding blade 1, which takes the form of a flat plate, comprises a main body 2 and an end portion 4 whereon a tab 5 is disposed in the form of a hook that is adapted to retain the packaging to be closed. The main body 2 can be attached to an axis of rotation 3 that transmits thereto a reciprocating rotational movement around the axis, first in one direction A and subsequently in the opposite direction B, in each operational cycle for the closure of the packaging, as shown in FIG. 1.

As regards the end portion 4, it is joined by articulation to the main body 2 by its free end opposite the axis of rotation 3, being adapted to rotate, coplanarly with the main body 2, around an axis of rotation 9 from an initial position in which the end portion 4 is folded over the main body 2, the situation of the folding blade 1 shown in FIG. 1, to a position of maximum rotation in relation to the main body 2 and the end portion 4, shown in FIG. 2.

As can be seen in FIGS. 1 and 2, the folding blade 1 also comprises an elastic means 6 that exerts a permanent pull on the end portion 4, thus maintaining it in the initial position, i.e. folded over the main body 2 of the blade 1. The end portion 4 will leave its initial position when the packaging to be closed exerts a predetermined force on the tab 5, making said portion rotate in relation to the axis of rotation 9 and its tab 5 will define a curvilinear path 7 in relation to said axis of rotation 9, as shown in FIG. 2. When said predetermined force on the tab 5 stops, e.g. when the folding blade 1 is withdrawn and rotates in direction B of FIG. 1, the end portion 4 will return to its initial position due to the pulling tendency of the elastic means 6. More specifically, the elastic means 6 consists of a calibrated spring, the ends of which are joined to the main body 2 and the end portion 4, respectively, and it can be housed inside a hole in the main body 2 created for this purpose in its free end opposite the axis of rotation 3.

As has been mentioned above, the folding blades 1 form part of a folding device used for the closure of packaging by folding two opposite portions of the same edge of the packaging once it has been filled. The folding blade 1 of the invention is applicable to folding devices with two folding blades 1, disposed opposite each other, or four folding blades 1 (two groups of two folding blades 1) each pair disposed opposite the other, which are able to move on the device's axes of rotation 3, the folding blades 1 being attached to the same axis of rotation 3 on which they can move towards or away from each other. Each folding blade 1, or group of blades 1, is attached to a respective axis of rotation 3 that transmits thereto the reciprocating rotational movement in directions A and B of FIGS. 1 and 2, the folding blades 1 being able to rotate simultaneously on their respective axes of rotation 3.

The behaviour of a folding blade 1, throughout a closure cycle, is described below:

Initially, each folding blade 1 on its respective axis of rotation 3 is disposed in position g1 as shown in FIG. 1, extending outwards, i.e. in the opposite direction to the position occupied by the packaging situated between the axes of rotation 3 of the respective blades 1, which is held by clips that are not shown in the drawing.

When the packaging is central in relation to the axes of rotation 3, it is closed subsequent to being filled. To achieve this, the clips move towards each other to close the upper part of the packaging, while at the same time each of the folding blades 1 rotates in the direction shown by arrow A in FIG. 1 towards position g2, i.e. moving towards the packaging to be closed by pushing a respective lateral portions 10 of the packaging inwards, creating a respective folds 100 in the lateral walls of the packaging.

It should be mentioned that in position g1 and in position g2 shown in FIG. 1, the end portion 4 is folded over the main body 2 of the blade 1, i.e. it remains in its initial position due to the action of the elastic means 6.

When a lateral portion 10 of the packaging is pushed by a folding blade 1, the tab 5 on its end portion 4 hooks and retains one or more openings in the mesh of the flexible tubular packaging during its rotating movement in relation to the axis of rotation 3. In many cases, due to the weight of the packaging filled with products, it exerts pressure on the tab 5, putting undesired strain on the threads or tapes of the mesh, which can damage and even break the packaging during the subsequent handling thereof.

To avoid this drawback, the end portion 4 of the folding blades 1 is adapted to rotate in relation to the main body 2 around the axis of rotation 9. Consequently, when the packaging exerts a predetermined force on the tab 5 of the folding blade 1, which retains at least one opening in the mesh, the tab 5 gives under said force and the end portion 4 rotates around the axis of rotation 9, the tab 5 describing the curvilinear path 7 shown in FIG. 2. On said curvilinear path 7, the tab 5 moves away from the main body 2, thus loosening the threads or tapes of the mesh of the packaging that were previously pulled tight by the movement of the folding blade 1 in direction A, in opposition to the direction of the force exerted on the tab 5. It should be added to the above that the fact that the end portion 4 has left its initial position, in which it was folded over the main body 2, does not prevent the blade 1 from continuing to rotate in relation to the axis of rotation 3.

The rotation of the end portion 4 in relation to the main body 2 is limited by the elastic constant of the calibrated spring that constitutes the elastic means 6 joining the two parts of the folding blade 1. Moreover, according to the embodiment shown in the drawings, this relative rotation is also limited by a chamfered edge of the main body 2, which acts as a stop. The position g2 of maximum rotation in relation to the main body 2 and the end portion 4 is that shown in FIG. 2, in which it can be seen that one of the edges of the end portion 4 comes into contact with said chamfered edge of the main body 2, preventing said end portion 4 from rotating beyond this position.

When said predetermined force on the tab 5 of the folding blade 1 stops, the end portion 4 returns to its initial position, folding over the main body 2 again due to the pulling effect of the elastic means 6.

Once the lateral portions 10 of the packaging have been inserted therein, forming respective folds, and the folding blades 1 having been withdrawn towards position g1 of FIG. 1, the two opposite portions of the edge that forms the aperture of the packaging are stuck and sealed, the resulting folds being contained between the two opposite portions.

As can be seen in FIGS. 1 and 2, a means of blowing 8 is disposed on the lateral parts of the end portion 4 of the folding blade 1 to blow air towards the lateral wall of the packaging in which the respective fold is formed.

Figure 3:
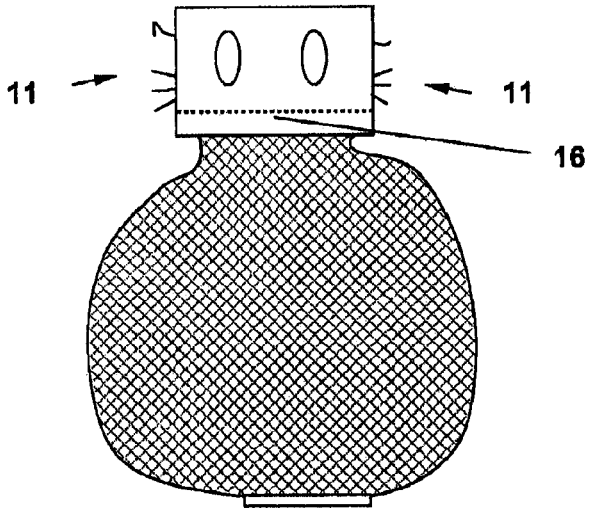
FIG. 3, is an elevation view of a mesh bag.

Thanks to the means of blowing 8 on the folding blade 1 it is possible to avoid situations such as that shown in FIG. 3, in which it can be observed that small sections 11 of the strands that form the threads or tapes of the packaging protrude from the lateral parts of the opposite portions 16 that are stuck together, causing a poor presentation of the packaging filled with the product. Said means of blowing 8 on the folding blades 1 blows air towards the packaging to be closed, thus helping any strands that there might be on the lateral walls in which the folds are formed to point towards said folds instead of protruding from the lateral parts of said opposite portions 16 of the packaging that are stuck together.

According to the embodiment shown in FIGS. 1 and 2, the means of blowing 8 consists of two pipes 12 disposed on either side of the end portion 4 of the folding blade 1. Each pipe 12 is provided with a first open end 14 destined to receive or be attached to a flexible conduit 13 for a pressurised air flow and a second open blowing end 15, through which air is blown towards the packaging to be closed.

Therefore, at the same time as a fold is formed in the respective opposite lateral wall of the packaging; when the folding blade 1 is in position g2 or g2', for instance, pressurised air is blown through the second open blowing end 15 of each conduit 12, so that all the portions of strands are contained between the two opposite portions that will be stuck and sealed when the packaging is closed.

It should be mentioned that the flexible conduits 13 for a pressurised air flow that are attached to the first open ends 14 of the pipes 12 are sufficiently flexible to move with the folding blade 1, both in the reciprocating rotational movement in directions A and B and in the relative rotational movement between the main body 2 and the end portion 4, without interfering in the development thereof, being capable of supplying pressurised air whenever necessary.

The invention claimed is:

1. A folding blade for closing flexible tubular packaging, said folding blade comprising:

a main body which is connectable to a first axis of rotation, said main body comprising a flat plate;

an end portion disposed on a lateral edge of the folding blade, said end portion being joined by articulation to the main body at an end opposite the first axis of rotation; and an elastic means that exerts a pulling force on said end portion, thus maintaining the end portion in an initial position in which the end portion is folded over the main body, wherein the main body is disposed opposite and perpendicular to a lateral portion of the flexible tubular packaging, wherein the first axis of rotation transmits a reciprocating rotational movement to the main body such that the main body rotates about the first axis of rotation, first in a direction towards the flexible tubular packaging, thereby pushing a portion of a lateral wall of the flexible tubular packaging to form an inward fold, and subsequently in an opposite direction, during each operational cycle, wherein said end portion comprises a hook which holds the flexible tubular packaging, and wherein, when a predetermined force is exerted on the hook by the flexible tubular packaging, the end portion rotates about a second axis of rotation along curvilinear path which is coplanar with the main body, and when said predetermined force stops, the elastic means pulls the end portion to the initial position.

2. The folding blade according to claim 1, wherein the end portion comprises a blowing means for supplying air in a direction of the lateral wall of the flexible tubular packaging where the inward fold is formed.

3. The folding blade according to claim 1, wherein the flat plate and the hook are coplanar.

4. The folding blade according to claim 1, wherein the flat plate, the hook, and the elastic portion are coplanar.

5. The folding blade according to claim 1, wherein the elastic means is housed within the main body.

* * * * *